US006949993B2

(12) United States Patent
Stolle et al.

(10) Patent No.: US 6,949,993 B2
(45) Date of Patent: Sep. 27, 2005

(54) CONNECTING DEVICE FOR CONNECTING AT LEAST TWO ANTENNA ELEMENT DEVICES, WHICH ARE ARRANGED OFFSET WITH RESPECT TO ONE ANOTHER, OF AN ANTENNA ARRANGEMENT

(75) Inventors: Manfred Stolle, Bad Aiblling (DE); Andreas Scheyer, Tuntenhausen (DE)

(73) Assignee: Kathrein-Werke KG, Rosenheim (DE)

( * ) Notice: Subject to any disclaimer, the term of this patent is extended or adjusted under 35 U.S.C. 154(b) by 99 days.

(21) Appl. No.: 10/455,795

(22) Filed: Jun. 6, 2003

(65) Prior Publication Data

US 2004/0203284 A1 Oct. 14, 2004

(30) Foreign Application Priority Data

Apr. 11, 2003 (DE) ..... 103 16 788

(51) Int. Cl.[7] ..... H01P 1/00; H21Q 21/00
(52) U.S. Cl. ..... 333/260; 343/853
(58) Field of Search ..... 333/24 R, 260; 343/795, 853, 858, 862, 892, 893, 904, 905, 906

(56) References Cited

U.S. PATENT DOCUMENTS

| | | | | |
|---|---|---|---|---|
| 2,275,646 A | | 3/1942 | Peterson et al. | 343/816 |
| 5,703,599 A | | 12/1997 | Quan et al. | 342/368 |
| 5,730,622 A | | 3/1998 | Olson | 439/578 |
| 5,917,455 A | * | 6/1999 | Huynh et al. | 343/792.5 |
| 6,005,522 A | * | 12/1999 | Arias et al. | 343/700 MS |

FOREIGN PATENT DOCUMENTS

| | | | |
|---|---|---|---|
| DE | 43 29 361 A1 | 3/1995 | H01P/5/12 |
| DE | 69313041 T2 | 12/1997 | H01R/17/12 |
| DE | 198 23 749 A1 | 12/1999 | H01Q/21/24 |
| DE | 19854503 C1 | 5/2001 | H01R/13/646 |
| EP | 0 826 250 B1 | 3/1998 | H01Q/3/34 |
| WO | WO 00/39894 | 7/2000 | H01Q/21/26 |
| WO | WO 01/13459 A1 | 2/2001 | H01P/1/18 |

* cited by examiner

*Primary Examiner*—Dean Takaoka
(74) *Attorney, Agent, or Firm*—Nixon & Vanderhye P.C.

(57) ABSTRACT

An improved connecting device produces an electrical connection between two antenna element arrangements which are offset with respect to one another. The connecting device has a housing arrangement which forms an outer conductor. The housing arrangement has a base, circumferential side wall sections with two opposite longitudinal side walls, and preferably two transverse side walls, which are provided opposite one another at the ends. An inner conductor holder is provided in the holding area which is formed by the circumferential side wall sections. An inner conductor is inserted into the inner conductor holder. The inner conductor is electrically conductively separated and/or isolated from the housing arrangement and/or from the inner conductor holder.

21 Claims, 6 Drawing Sheets

CONNECTING DEVICE FOR CONNECTING AT LEAST TWO ANTENNA ELEMENT DEVICES, WHICH ARE ARRANGED OFFSET WITH RESPECT TO ONE ANOTHER, OF AN ANTENNA ARRANGEMENT

CROSS-REFERENCES TO RELATED APPLICATIONS

Not applicable.

STATEMENT REGARDING FEDERALLY SPONSORED RESEARCH OR DEVELOPMENT

Not applicable.

FIELD

The technology herein relates to a connecting device for connecting at least two antenna element devices, which are arranged offset with respect to one another, of an antenna arrangement.

BACKGROUND AND SUMMARY

Antenna arrays, in particular for base stations for mobile radio communications devices, generally have a vertically aligned reflector arrangement in which two or more antenna element devices are provided, and are arranged offset one above the other in the vertical direction. These may be single-polarized antenna element arrangements or, in general, dual-polarized antenna element arrangements which transmit and receive with polarizations which are offset through 90° with respect to one another.

Furthermore, these may be antenna arrangements which receive beams in only one frequency band or in two or more frequency bands, for which purpose antenna element arrangements are then provided which are matched to the appropriate frequency bands. To this extent, reference is made by way of example to the previously published antenna arrangements according to DE 198 23 749 A1.

In the case of antenna arrangements, especially for mobile radio communications technology, it is in some cases also desirable to be able to set or preselect a specific beam angle. For example, phase shift arrangements such as those which are known from WO 01/13459 A1 may be used to vary the so-called down-tilt angle. Adjustment of the phase shift element results in a delay time change and hence in a phase shift, so that it is possible to adjust the down-tilt angle.

However, as mentioned, there are also situations in which, for example, a pair of antenna element arrangements which are arranged one above the other should in each case be operated at a down-tilt angle which, although it can be preselected, is then preset in a fixed manner. It is also possible, for example by means of the phase shift arrangement which is already known from the cited WO 01/13459 A1, to feed not only in each case one individual antenna element to be fed but, for example, a pair of antenna elements which are arranged adjacent and vertically one above the other. In such a case, this pair of antenna elements are then preferably operated with a fixed preset phase angle relative to one another and thus with a fixed defined down-tilt angle which acts relatively between these two antenna elements. If, by way of example, a pair of antenna elements such as these are also driven with different phase angles via the phase shifters which have been mentioned, then it is possible to set a greater or lesser down-tilt angle, although a relative phase offset and hence a relative different down-tilt angle will then always remain as a permanent preset. This can be achieved by designing the coaxial cable which leads to one antenna element of the pair of antenna elements to be somewhat longer than the coaxial cable which leads to the second antenna element in the pair of antenna elements, so that the change in the delay time produces the desired relative phase offset.

Furthermore, a pair of antenna element arrangements such as these which can be fed with different phase angles can be connected using a stripline technique.

A certain amount of transformation is also frequently carried out in this case, and this means that an impedance conversion device is often or typically required. This impedance conversion device may likewise once again be provided by means of stripline technology or by using boards or coaxial cable solutions. If a coaxial cable is used as a feed, then any desired impedance conversion can be achieved, for example, by using two coaxial cable sections with different internal conductor diameters, connected in series.

In one comparatively simple antenna arrangement using stamped dipole antenna elements, electrical power splitting between antenna elements which are arranged offset with respect to one another in front of a reflector plate, for example in the form of dipole antenna elements, can also be achieved via an elongated stamped transmission line which has an intermediate line section which, for example, has a narrower width. This allows the transformation and impedance conversion to be carried out. By preselecting the feed point for an inner conductor cable which is to be connected (e.g., soldered coaxial cable), it is then possible to set the phase shift, which can be preselected, for the two antenna element arrangements, and hence a down-tilt angle which can be preselected, in a fixed and permanent manner. One implementation as described above has been disclosed for example, in EP 0 826 250 B1.

The illustrative non-limiting technology described herein provides an improved feed and connecting device for at least in each case one pair of antenna element devices which are arranged offset with respect to one another, which feed and connecting device can be used for widely differing types of antennas and which at the same time is intended to be as insensitive as possible to external influences, for example interference fields.

An exemplary illustrative non-limiting connecting device allows a direct connection to in each case one pair of antenna element devices which are arranged offset with respect to one another, to be precise in a low-cost implementation. In such a case, two antenna elements, for example in the form of two dipole arrangements, are connected taking into account impedance matching, power matching and/or phase matching. The electrical characteristics are preferably, in one exemplary illustrative non-limiting arrangement, achieved only by varying the outer conductor (in particular by varying a cross section) and/or only by varying the dielectric (in particular by varying the cross section). This makes it possible to use an inner conductor without any sudden diameter changes, and this has been found to be particularly cost-effective. The exemplary illustrative non-limiting connecting device may also be used irrespective of the reflector or reflector type being used. Advantages are also obtained in particular if the solution is designed using a casting technique. This also contributes to a cost-effective solution. In particular, the exemplary illustrative non-limiting connecting module is insensitive to external influences, in particular such as interference fields and can be used irrespective of the reflector type. In the process, a direct connection is created to the respective antenna element, in particular dipole antenna element.

One illustrative non-limiting particularly advantageous arrangement provides a connecting device implementation that is in integral form, to be precise with an outer conductor housing which in the end can be handled integrally and has an integrated inner conductor. In particular, this also avoids intermodulation problems, such as those which occur frequently in the prior art in a disadvantageous manner that is difficult to deal with.

In one exemplary illustrative non-limiting implementation, the entire outer conductor arrangement is produced using casting technology, with the inner conductor being produced by insertion of an inner conductor or inner conductor wire that preferably has no sudden changes in diameter. The inserted inner conductor is electrically conductively isolated from the outer conductor arrangement by the use of appropriate plastic holders, that is to say, in general nonconductive elements.

The coaxial cable feed can be connected at a connection point which is preferably provided in the central area of the connecting device.

The exemplary illustrative non-limiting arrangement may preferably also be in the form of a double arrangement, preferably being symmetrical with respect to a vertical plane of symmetry running in the longitudinal direction, to be precise with two connections points which are preferably arranged centrally opposite one another, preferably for two coaxial cables. This makes it possible to provide a feed to two pairs of antenna element arrangements which, for example, act as a dual-polarized antenna element arrangement, thus having an appropriate feed via a separate inner conductor for each of the two polarizations. The outer conductor arrangement is provided for both inner conductors, with the two inner conductors preferably being screened from one another by means of a longitudinally running vertical web which is electrically connected to the outer conductor arrangement.

In one exemplary illustrative non-limiting implementation, the connecting device is in the form of a component which can be handled on its own and can be inserted, and fitted to a reflector, as required. In one alternative exemplary implementation, the outer conductor arrangement may, however, also be produced as an integral functional part, in the factory, as part of the reflector arrangement, preferably on the side of the reflector facing away from the antenna element arrangement. With an implementation such as this, all that is necessary is to insert an inner conductor arrangement into the outer conductor arrangement of the connecting device, which forms a functional part of the reflector, with the functional part that is formed in this way being closed by fitting a cover arrangement.

Since, in the exemplary illustrative non-limiting solution, both the inner conductor and the outer conductor housing are, in the end, integral and can be handled integrally no intermodulation problems occur either, as is of major importance especially for mobile radio communications technology.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
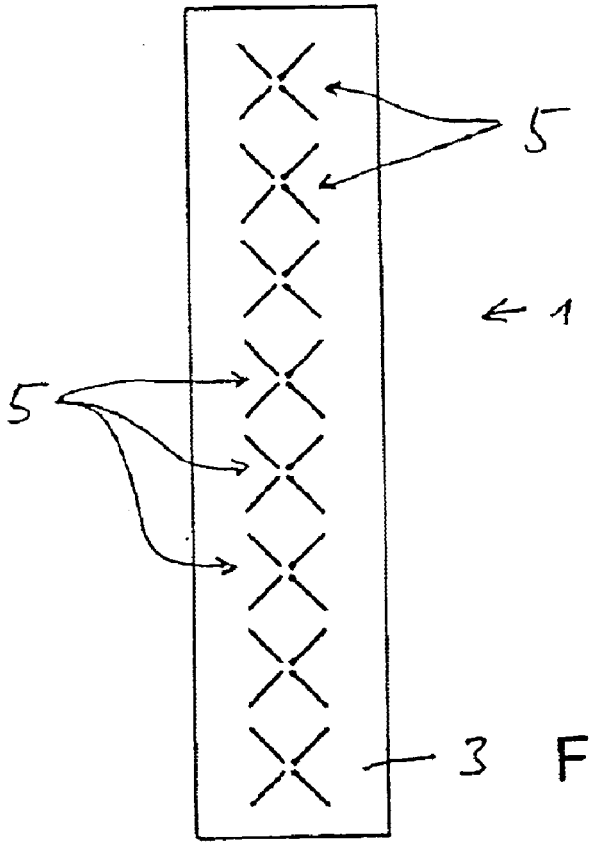
FIG. 1 shows an illustrative non-limiting exemplary schematic plan view of an antenna arrangement having a reflector and having eight antenna element devices which are arranged one above the other in the form of cruciform dipoles.

FIG. 1 shows a schematic illustration of an antenna arrangement 1 with a reflector, to be precise in the illustrated exemplary illustrative non-limiting implementation with eight antenna element arrangements 5 which are arranged with a vertical offset one above the other. In the illustrated exemplary non-limiting implementation, the antenna element arrangements 5 comprise a dual-polarized antenna element arrangement, for example in the form of cruciform antenna element arrangements. However, other dipole antenna element arrangements, for example in the form of a dipole square, of a so-called vector dipole corresponding to the prior publication WO 00/39894 A1 or else, for example, in the form of patch antenna elements, as have been known for a long time, may also be used. To this extent, reference is made to the antenna element arrangements which are known to those skilled in the art and which can be used for comparable purposes.

Figure 2:
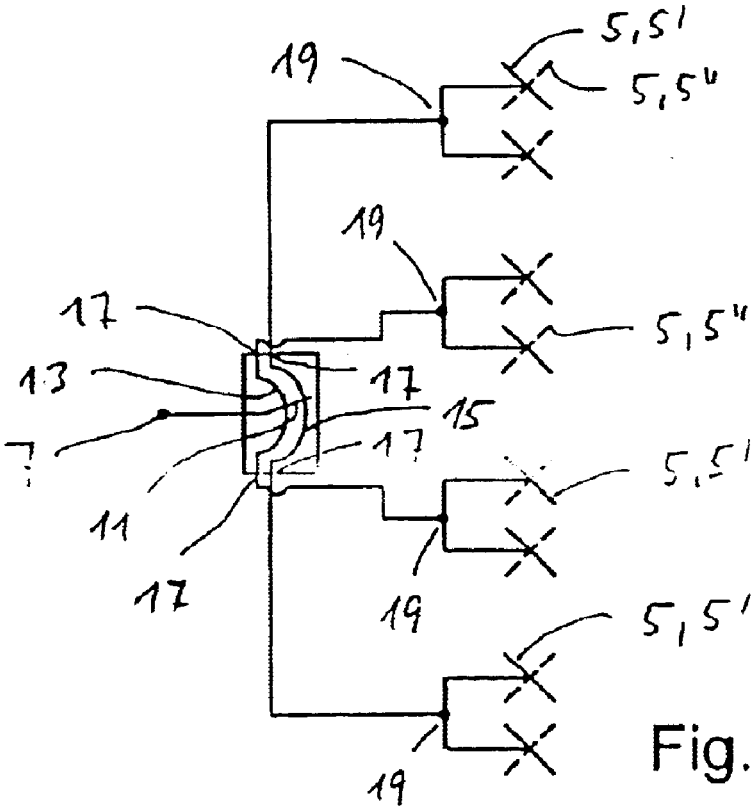
FIG. 2 shows an illustrative non-limiting exemplary schematic illustration showing how different down-tilt angles are set by means of a double phase-shifter device using in each case one connecting device for one pair of antenna element arrangements.

One polarization of the antenna element arrangement 5 may in each case be fed, for example, via a feed network as shown in FIG. 2, which has one feed input 7 for each polarization and, in the illustrated exemplary implementation, a double phase-shift assembly 9, as is known in principle from WO 01/13459 A1. To this extent, reference is also made to this prior publication with regard to the prior art as discussed in this prior publication, and this is included in the content of this application.

The feed input 7 is in this case connected via an adjustment element 11, in the form of a pointer, of the phase-shifter assembly 9, and this engages around two stripline sections 13 and 15. Depending on the adjustment position of the adjustment element 11, the energy which is fed in is in this case supplied with a different phase angle to the antenna elements which are being fed via it, by virtue of the different delay time lengths in the stripline sections 13, 15, with the four outputs 17 of the phase-shift arrangements 9 in the illustrated exemplary non-limiting implementation each being connected via one connecting device 19, which will be explained in detail in the following text, to the antenna elements 5' associated with one polarization.

A corresponding circuit design (not shown in FIG. 2) is provided for the antenna elements 5" for the second polarization, with the antenna elements for the second polarization being indicated only by dashed lines in FIG. 2.

The connecting device 19 will thus be described in the following text, via which one pair of antenna elements 5' or 5", which are arranged adjacent to one another, are in each case fed.

In the cross-sectional illustration shown in FIG. 3, the cap areas 5*a* are shown, for example of two balancing elements of two antenna element arrangements 5 which are arranged adjacent to one another and are mounted on the front face of the reflector 3 while, in contrast, a connecting device 19, which will be described in detail in the following text, is mounted on the opposite face of the reflector 3, which thus faces in the rearward direction, in order to feed these two adjacent antenna element arrangements 5.

The explained connecting device 19 is in the form of a connecting module which can be handled in a standard manner, preferably using casting technology, for example aluminum casting technology. Any suitable appropriately processed materials may be used. For this purpose, the connecting device 19 has a housing or a holding device 19' with a base 19*a* and a circumferential side wall section which extends transversely and, in the illustrative exemplary non-limiting implementation, at least essentially vertically, and which is subdivided into the longitudinal side walls 19*b* and the transverse side walls 19*c* arranged at the ends. The base 19*a* together with the side wall sections 19*b* and 19*c* forms the outer conductor 19".

Since the explained exemplary non-limiting illustrative implementation is used for feeding two pairs of antenna element arrangements, namely one pair of antenna elements 5' for one polarization and a second antenna element pair 5" for a second polarization at right angles to the first, the explained connecting module 19 is equipped with a central longitudinal web 19*d* (through which, in the illustrated exemplary non-limiting implementation, a central plane of symmetry runs transversely with respect to the base 19*a*), which is likewise part of the outer conductor 19".

A cover 19*e* can be fitted to the circumferential side wall sections 19*b* and 19*c* and to the central longitudinal web 19*d* in order to close the entire arrangement from the outside, and if required to screen it. The cover 19*e* which is fitted in FIG. 4 may be composed of a nonconductive, for example plastic, material. This cover may also be made of metal, but only if additional screening is desired, in which case the cover need not be a casting but may also be manufactured from a bent metal part. The cover is preferably fitted via side lugs 19*f*, which run on an inclined ramp or tab 19*g*, with the holder sections engaging or latching behind the tab 19*g* when in the finally fitted position.

Figure 6:
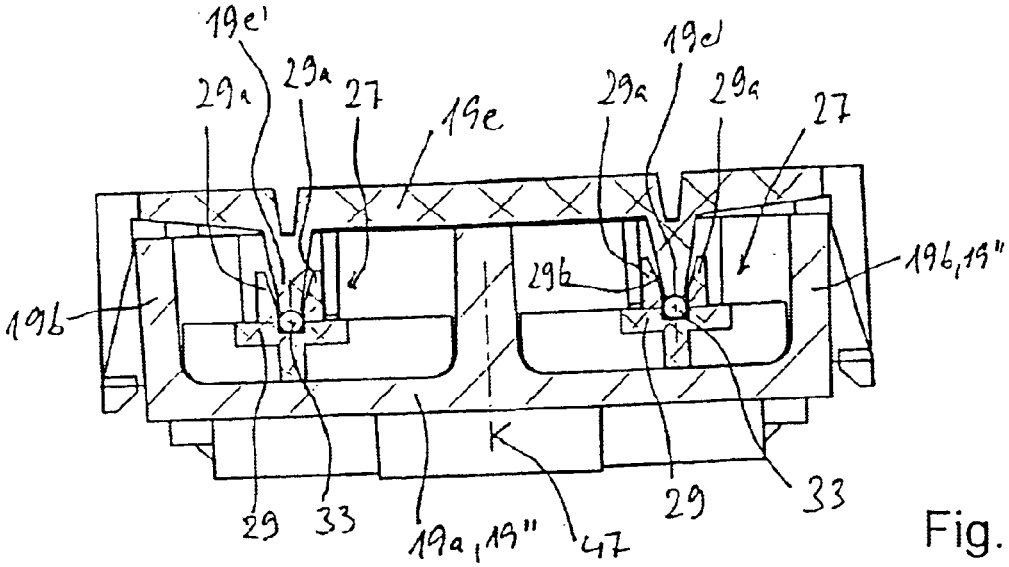
FIG. 6 shows an illustrative non-limiting exemplary cross-sectional illustration along the line V—V FIG. 4.
Figure 7:
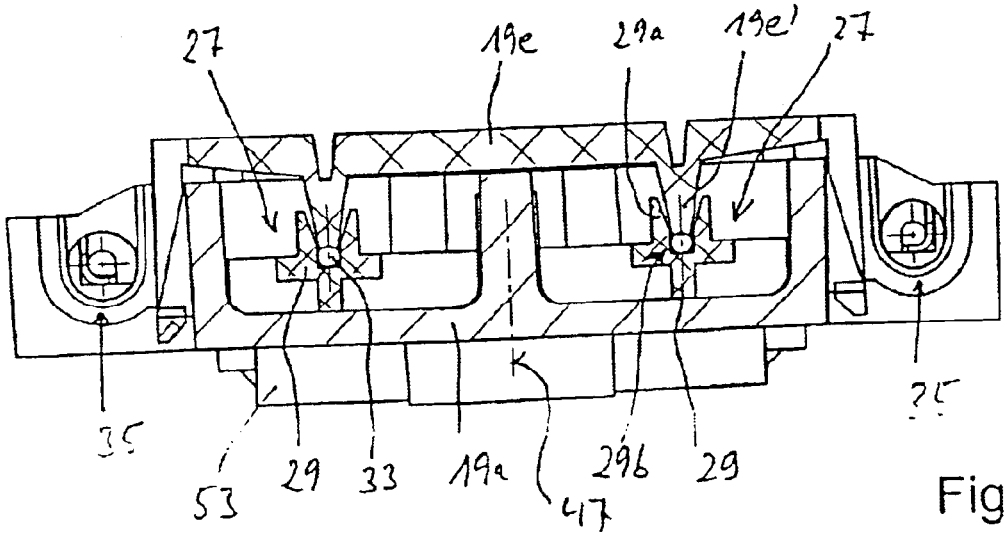
FIG. 7 shows an illustrative non-limiting exemplary further cross-sectional illustration along the line VI—VI in FIG. 4.

As can also be seen in particular from FIGS. 6 and 7, which are in the form of cross sections, the explained design results in an outer conductor arrangement with two elongated holding areas 27, into each of which an electrically nonconductive inner conductor holder 29 is inserted. This is preferably composed of a plastic which acts as a dielectric. The holder can be inserted such that it can be inserted permanently and in a fixed manner into the holding areas 27. However, if it were inserted loosely, it would also in the end be fixed in a predetermined position when the cover 19*e* that has been mentioned is fitted.

The cross section of the inner conductor holder 29 has fork-like side webs 29*a* which run outward, that is to say they diverge slightly in the upward direction. This results in a groove with a slightly V-shaped cross section or a holding slot or holding area 19*b* which is slightly V-shaped, in whose area, adjacent to the groove base, it may had side wall sections which run parallel to one another or are even aligned such that they diverge slightly toward the base of the groove so that, once the inner conductor 33, which is in the form of a cable, has been pressed into the groove bed, it is secured against inadvertently moving out of the holder 29*b*, which is in the form of a groove.

Furthermore, it is also clear from the exemplary non-limiting illustrative implementation that the cover arrangement 19*e*, which is preferably composed of plastic, is provided on the inside of the cover with a pair of ribs 19*e'*, which project downward and which, when the cover is fitted, engage in the holder 29*b*, which is in the form of a groove, and are designed such that, when the cover is fitted, they hold the inner conductor 33 (which is inserted into the holder 29*b* that is in the form of a groove) in this holder 29*b*, which is in the form of a groove, in a fixed and captive manner. For this purpose, the cross section of the ribs 19*e'* converges slightly in the form of a wedge and, at their projecting end, they have a flattened, and possibly even slightly concave, contact section which rests on the inner conductor 33 when fitted.

In the illustrated exemplary implementation, two connection points 35 are provided on the two opposite longitudinal faces 19*d*, preferably in the central area, to which two coaxial cables 37 can be passed, for example from the explained antenna element or dipole arrangement. The outer conductors make electrical contact with the conductive housing of the connecting device or with the connecting module 19 while, in contrast, the inner conductors are electrically conductively connected, preferably by soldering, to the inner conductor 33 (which is bare at least in this section) via an electrical transverse link 39, while being isolated from the housing. In the illustrated exemplary illustrative non-limiting implementation, the inner conductor 33 has no cable insulation anywhere over its entire length since, according to the exemplary illustrative non-limiting implementation, the inner conductor 33 is inserted in an inner conductor holder 29 which is composed of plastic and acts as insulation. In the exemplary non-limiting implementation, transformation or impedance matching is not carried out by varying the cross section of the inner conductor 33 (which would be complex) but by appropriate different configurations of the external size or cross-sectional size of the opposite longitudinal side walls 19*b* which form the outer conductor of the connecting device. In this case, furthermore, the distance from the base 19*a* is also important, so the distance from the base 19*a* can likewise be varied in order to make a contribution to the transformation or impedance matching, or to make it possible to make such a contribution.

Figure 4:
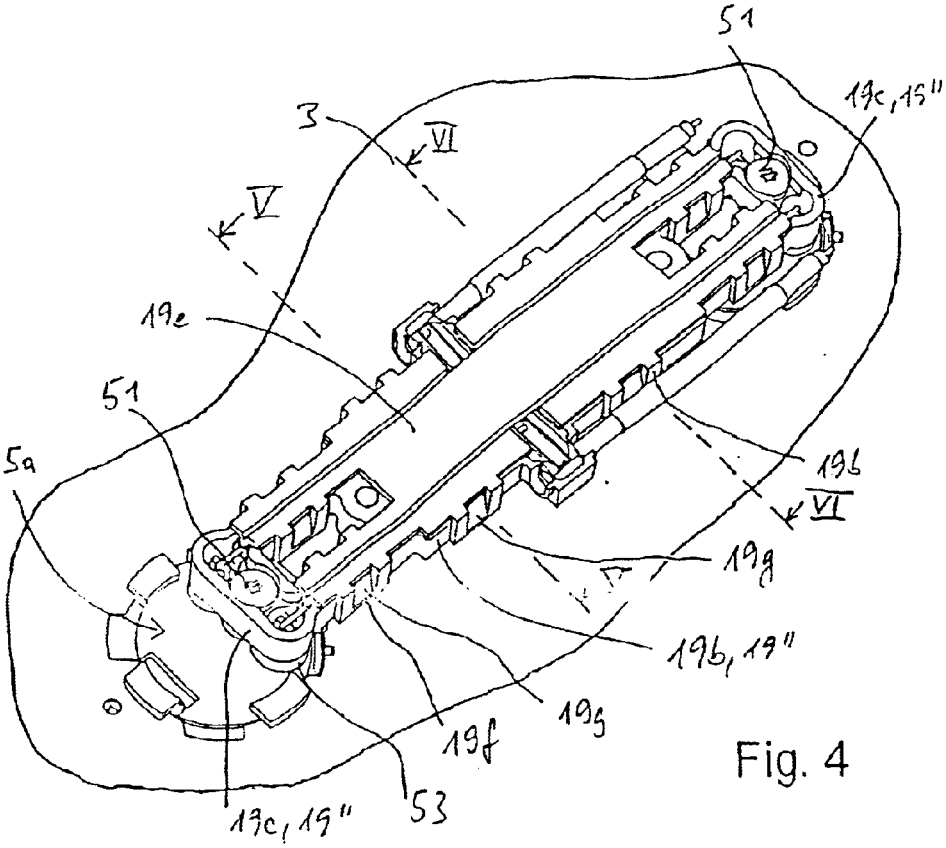
FIG. 4 shows an illustrative non-limiting exemplary schematic perspective illustration of the connecting device, with a cover fitted.

As can be seen from the illustration exemplary illustrative non-limiting implementation, in particular from FIG. 4 as well, the electrical connection points 35 for the feed from the coaxial cables 37 are not arranged centrally with respect to the longitudinal direction of the connecting module 19, but slightly off-center, so that, for example, the feed path from the connection points 35 to the connection points at the opposite end (that is to say on the opposite end faces 19*c* of the connecting module) has a different length, thus resulting in the desired phase shift, which is preselected by the overall geometric arrangement, for the adjacent antenna elements, thus presetting a specific down-tilt angle. In contrast to the illustrated exemplary implementation, the feed may, however, also be provided exactly centrally, specifically when the two antenna element arrangements, which are fed via the connecting device and are arranged adjacent to one another, are intended to be fed with the same phase angle.

Figure 8:
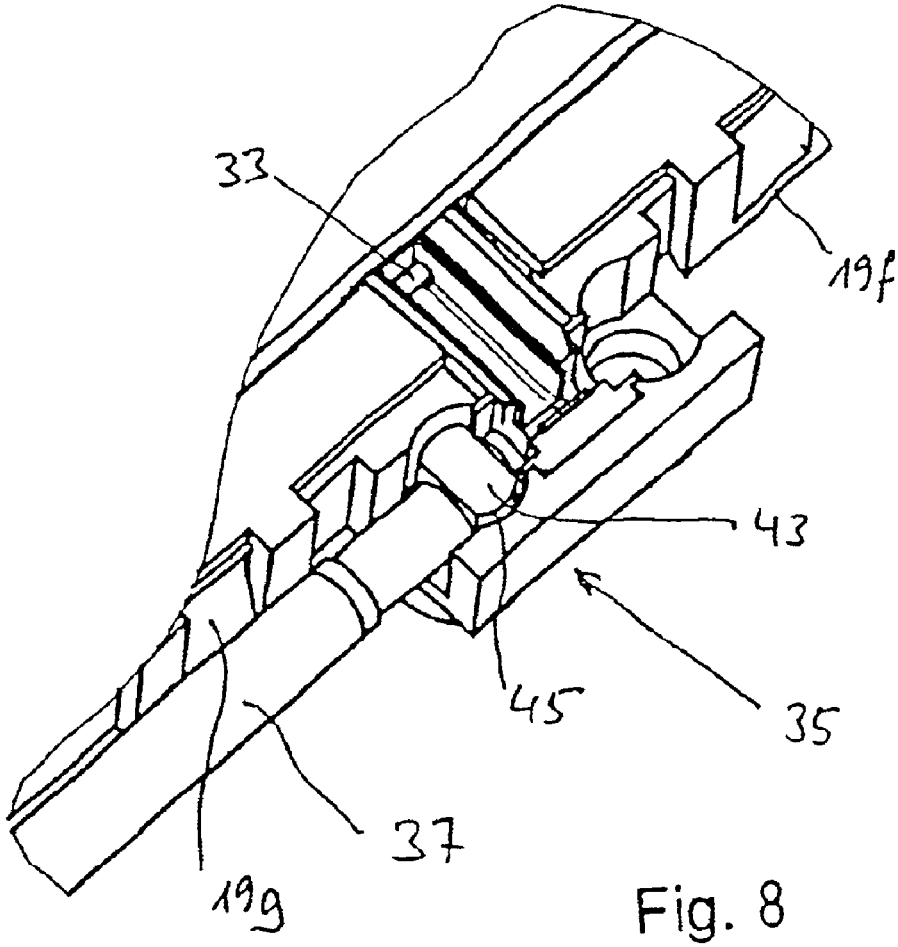
FIG. 8 shows an enlarged detail illustration from FIG. 5, showing the connection of coaxial feed lines to the connecting device.

FIG. 8 shows an enlarged detail illustration of one of the two connection points 35. As can be seen from the figure, the outer conductor, for example, is provided with an electrically conductive outer conductor head 43 seated on it, which is inserted into a corresponding recess 45 at the connection point 35 and is thus electrically connected to the outer conductor, which is in the form of a housing, of the connecting device. The inner conductor of the coaxial cable is passed, electrically isolated from this, via an opening in the longitudinal side walls 19*b* to the respectively associated inner conductor 33, and is electrically connected to it. As explained, the connecting device is in the form of a double connecting device with two inner conductors 33, so that it can be used to feed two mutually perpendicular polarizations to the two antenna elements which are arranged offset with respect to one another. The connecting device is in this case preferably designed to by symmetrical about a vertical longitudinal plane of symmetry 47 (FIG. 6). The connecting device formed in this way is then attached in some suitable manner to, for example, the rear face of a reflector 3, for example being welded or soldered to it, or being mounted by means of screws or other attachment devices. However, in contrast to this, it is also possible to connect the explained connecting device only to the two dipoles, that is to say to the antenna elements, but not to the reflector. In other words, the connecting part may also be fitted such that it does not touch the reflector once, as can also be seen from the cross-sectional illustration in FIG. 3.

Figure 9:
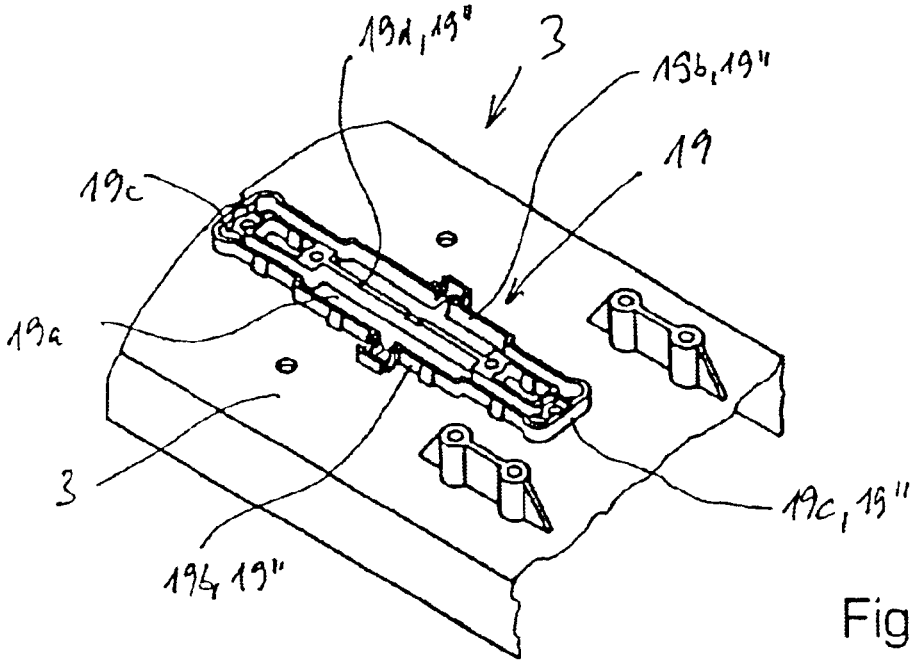
FIG. 9 shows a modified perspective lower view, in the form of an extract, of the reflector with the connecting part integrally connected to the reflector.
Figure 10:
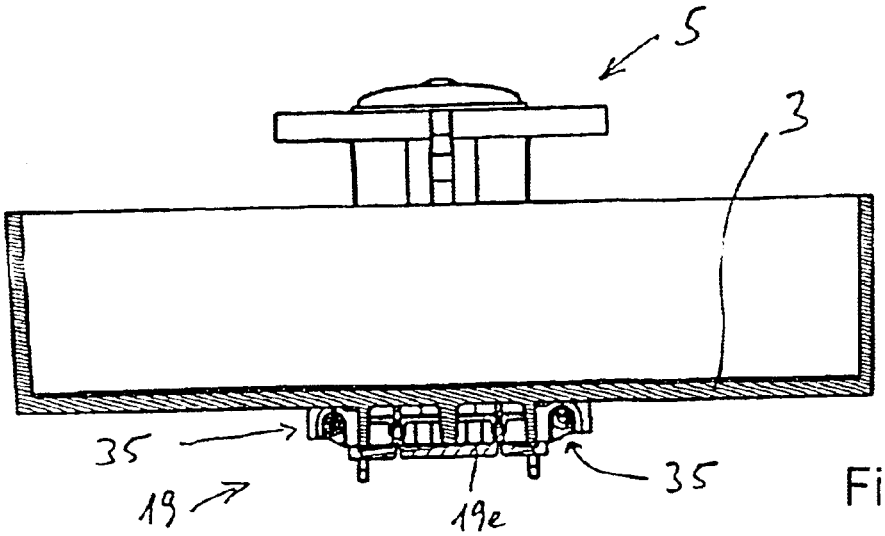
FIG. 10 shows a corresponding cross-sectional illustration through the exemplary arrangement shown in FIG. 9.

FIG. 9 provides a schematic perspective illustration, in the form of an extract, of the rear face of a reflector 3, and FIG. 10 provides a schematic cross-sectional illustration transversely with respect to the longitudinal direction of the reflector 3, showing that the connecting device, that is to say the connecting module 19, may not only be in the form of a component which may be handled separately but may also be in the form of a functional part which is integrated into the reflector arrangement, and in which the base 19*a* of the connecting module 19 is formed by the material of the reflector 3 itself. In other words, the explained longitudinal side walls 19*b* which are used as the outer conductor, the transverse side walls 19*c* and the central longitudinal web 19*d* that is provided form an integral part of the overall reflector arrangement.

Figure 3:
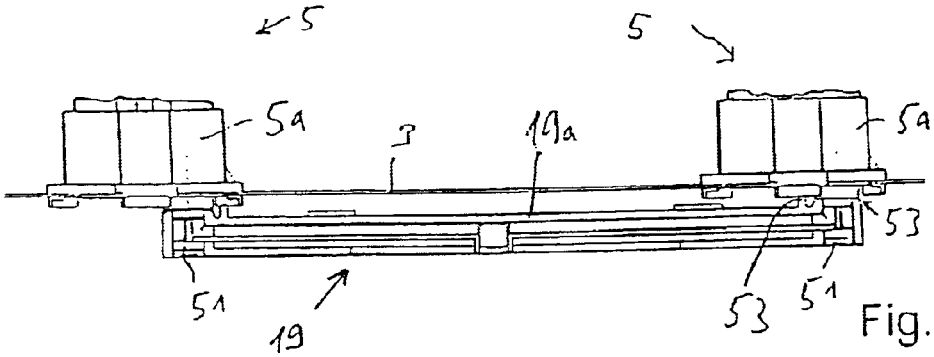
FIG. 3 shows an illustrative non-limiting exemplary schematic vertical section illustration through a reflector with two antenna element arrangements which are arranged offset and are fed via one connecting device.
Figure 5:
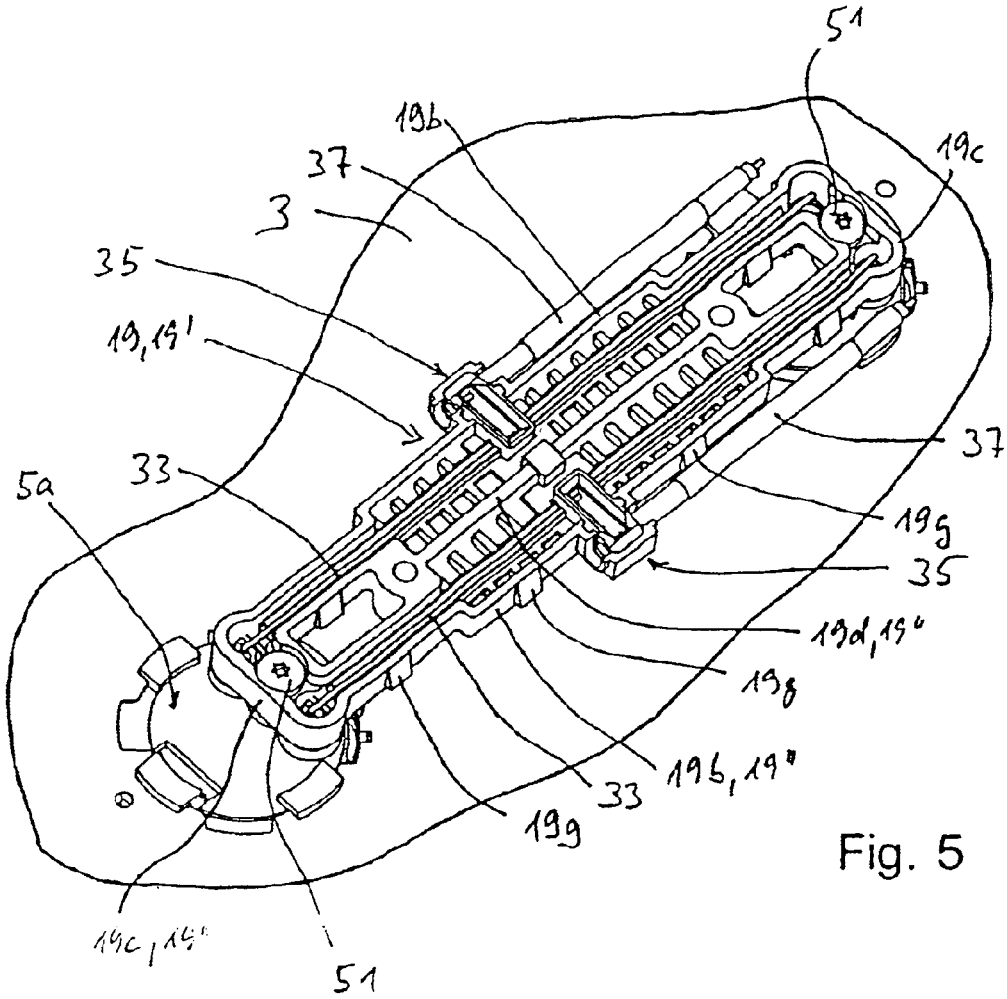
FIG. 5 shows an illustration corresponding to FIG. 4, with the cover removed.

As can be seen from the figures, for example from FIG. 3, FIG. 4 or else FIG. 5, the explained connecting device 19 or the connecting part is attached by means of two screws 51, for example being connected to the antenna elements or dipoles directly by means of the screws 51, that is to say in particular to the associated cap areas 5*a* of the antenna element device. In this case, both polarizations of the dipole are preferably mechanically connected to and make electrical contact with the connecting part by means of a screw, that is to say they are mechanically connected to and make electrical contact with the connecting device. In other words, a connection is produced to the outer conductor of the connecting device 19 in this way. In this case, corresponding supporting areas 53 of the connecting device 19 are then located, and project downward over the actual base 19*a* in the direction of the attachment services or caps 5*a* of the dipole devices. In other words, in an illustrative non-limiting implementation such as this, the base 19*a* of the connecting device 19 would not rest on the reflector 3, and would not touch it.

In contrast to the explained exemplary illustrative non-limiting implementation, the explained connecting module 19 may, of course, also be used for feeding a pair of antenna element arrangements with only single polarization. The connecting module 19 would then have only the circumferential outer walls 19*b*, 19*c*, without the central longitudinal web 19*d*. Only one inner conductor 33 would then be laid in the one holding area 27 that would then be formed, using only one corresponding inner conductor holder 29.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. Connecting device for producing an electrical connection between two antenna element arrangements which are offset with respect to one another, having an inner conductor connection and an outer conductor connection, preferably with a different cable length to the two antenna element arrangements which are arranged offset, in order to produce a different phase angle and hence a down-tilt angle which can be preselected and/or, preferably, integrated impedance matching and/or power matching for the at least two antenna element arrangements which are connected, characterized by the following further features:

the connecting device has a housing arrangement which forms an outer conductor, the housing arrangement has a base, circumferential side wall sections with two opposite longitudinal side walls, and preferably two transverse side walls, which are provided opposite one another at the ends, an inner conductor holder is provided in the holding area which is formed by the circumferential side wall sections, an inner conductor is inserted into the inner conductor holder, and the inner conductor is electrically conductively separated and/or isolated from the housing arrangement and/or from the inner conductor holder.

2. Connecting device according to claim 1, characterized in that the inner conductor holder is composed of nonconductive material, preferably of plastic.

3. Connecting device according to claim 1, characterized in that the inner conductor consists of a wire.

4. Connecting device according to claim 1, characterized in that the inner conductor consists of an uninsulated wire.

5. Connecting device according to claim 1, characterized in that the impedance and/or the power matching can be predetermined by the configuration of the housing or of the outer conductor, in particular by its shape and the configuration of the all thicknesses.

6. Connecting device according to claim 1, characterized in that the impedance and/or power matching can be preselected by the configuration of the inner conductor holder.

7. Connecting device according to claim 1, characterized in that the impedance and/or power matching can be preselected by the use of a dielectric.

8. Connecting device according to claim 1, characterized in that the connecting device is in the form of a double module, namely using two inner conductors, which are arranged with a lateral offset with respect to one another and are preferably separated from one another via a conductive central longitudinal web which is provided between the two inner conductors.

9. Connecting device according to claim 8, characterized in that the central longitudinal web is part of the housing of the connecting device and is designed to be electrically conductive.

10. Connecting device according to claim 1, characterized in that the housing of the connecting device is electrically conductive, using electrically conductive metal.

11. Connecting device according to claim 1, characterized in that the housing is composed of nonconductive material and is provided with at least one electrically conductive surface.

12. Connecting device according to claim 1, characterized in that the connecting device, which is in the form of a housing, can be closed by means of a cover.

13. Connecting device according to claim 12, characterized in that the cover is composed of plastic.

14. Connecting device according to claim 1, characterized in that the inner conductor holder has a holding are which is preferably in the form of a groove, for retention and holding of the inner conductor.

15. Connecting device according to claim 12, characterized in that, on its inner face, the cover has a projecting arrangement preferably in the form of a projecting web or a projecting rib, or in the form of projections which are spaced apart from one another, which, when the cover is fitted, projects or project into the holding area, which is in the form of a groove and in which the inner conductor is arranged.

16. Connecting device according to claim 1, characterized in that the connecting device (19) comprises a connecting module (19') which can be handled in a standard manner and is in the form of a housing.

17. Connecting device according to claim 1, characterized in that, as an integrated functional part, the connecting device is integrally connected to a reflector, and/or is produced integrally with a reflector, such that the base of the connecting device is part of the reflector, and such that the side wall sections and, preferably, a central longitudinal web which is provided are integrally and firmly connected to the reflector.

18. Connecting device according to claim 1, characterized in that the connecting device is produced as an integrated component of the reflector using a master gauge method, preferably using a die-casting, injection-molding, stamping or forming method.

19. Connecting device according to claim 1, characterized in that the connecting device is attached via at least two screws, either to the reflector or preferably to the antenna element devices or dipole devices, preferably to their cap.

20. Connecting device according to claim 18, characterized in that the connecting device is arranged at least at a short distance from the reflector and rests on and is attached to the antenna elements or dipole elements, preferably on or to their cap area, by means of projecting section areas, with the cap area being exposed in appropriate recesses in the reflector device.

21. Connecting device according to claim 1, characterized in that the connecting device is mounted such that it rests directly on the reflector.

* * * * *